United States Patent [19]

Takahashi

[11] Patent Number: 4,772,236

[45] Date of Patent: Sep. 20, 1988

[54] EXHAUST GAS PURIFYING DEVICE FOR MARINE ENGINE

[75] Inventor: Masanori Takahashi, Hamamatsu, Japan

[73] Assignee: Shanshin Kogyo Kabushiki Kaisha, Hamamatsu, Japan

[21] Appl. No.: 5,603

[22] Filed: Jan. 21; 1987

[30] Foreign Application Priority Data

Feb. 28, 1986 [JP] Japan ..... 61-43424

[51] Int. Cl.[4] ..... B63H 23/32

[52] U.S. Cl. ..... 440/89; 60/302

[58] Field of Search ..... 440/88, 89; 60/272, 60/299, 302

[56] References Cited

U.S. PATENT DOCUMENTS

| | | | |
|---|---|---|---|
| 3,644,098 | 2/1972 | De Palma | 60/203 |
| 3,967,446 | 7/1976 | Harralson et al. | 440/89 |
| 3,968,645 | 7/1976 | Noguchi et al. | 60/302 |
| 3,972,184 | 8/1976 | Warren | 60/302 |
| 4,023,361 | 5/1977 | Kojima | 60/302 |
| 4,354,849 | 10/1982 | Sanmi et al. | 440/89 |
| 4,372,111 | 2/1983 | Virk | 60/297 |
| 4,495,153 | 1/1985 | Midorikawa | 60/302 |

FOREIGN PATENT DOCUMENTS

| | | | |
|---|---|---|---|
| 2913733 | 10/1979 | Fed. Rep. of Germany | 60/302 |
| 3018277 | 12/1980 | Fed. Rep. of Germany | 60/302 |
| 2913733 | 10/1979 | Fed. Rep. of Germany | 60/302 |
| 10043 | 1/1980 | Japan . | |
| 19940 | 2/1980 | Japan . | |
| 19939 | 2/1980 | Japan . | |
| 14977 | 2/1980 | Japan . | |
| 150099 | 9/1982 | Japan . | |
| 151200 | 9/1982 | Japan . | |
| 203814 | 12/1982 | Japan | 60/302 |

*Primary Examiner*—Joseph F. Peters, Jr.
*Assistant Examiner*—Stephen P. Avila
*Attorney, Agent, or Firm*—Ernest A. Beutler

[57] ABSTRACT

An outboard motor having an improved catalyst system for treating the exhaust gases regardless of whether they are delivered to the atmosphere through an above the water exhaust gas discharge or a below the water exhaust gas discharge. When the engine is operating at high speeds, the exhaust gases only have surface contact with the catalyzer bed and do not flow through it while under slow speeds the exhaust gases flow through the catalyzer bed.

10 Claims, 2 Drawing Sheets

EXHAUST GAS PURIFYING DEVICE FOR MARINE ENGINE

BACKGROUND OF THE INVENTION

This invention relates to an exhaust gas purifying device for a marine engine and more particularly to an improved, simplified and highly effective system for treating the exhaust gases of an engine prior to their discharge to the atmosphere.

In many types of applications for internal combustion engines, the engine exhaust gases are delivered to the atmosphere through alternate exhaust gas discharges. For examples, in connection with outboard motors, it is normally the practice to discharge the exhaust gases through an underwater exhaust gas discharge when traveling at high speeds. However, when traveling at lower speeds and when the high speed exhaust gas discharge is more deeply submerged, the exhaust gases are normally delivered directly to the atmosphere through an above the water exhaust gas discharge. Although such arrangements are satisfactory, if it is desired to treat the exhaust gases with a catalyzer so as to prevent the discharge of unwanted exhaust gas constituents to the atmosphere, the system for treating the exhaust gases can be extremely cumbersome.

It is, therefore, a principal object of this invention to provide a relatively simple and highly effective arrangement for treating the exhaust gases of an internal combustion engine in which the exhaust system has two different atmospheric discharges.

It is a further object of this invention to provide an improved, simplified and high effective system for treating the exhaust gases of an internal combustion engine before their discharge to the atmosphere through either of two alternative exhaust gas discharges.

In the outboard motors, like many other applications, it is necessary to insure good contact between the exhaust gases and the catalyst in order to insure effective treatment before discharge to the atmosphere. Also, it is necessary to insure that the catalyst operates at the necessary temperature so as to achieve the desired exhaust gas treatment. Normally, it has been the practice to cause the exhaust gases to flow through a catalyst bed in order to achieve the desired treatment. However, this can present certain difficulties in that restrictions to the flow of exhaust gases may be unduly high under some circumstances. Also, it is frequently necessary to use different catalyzers and the passage of the exhaust gases through a series of catalyzers can give rise to objectionable restrictions.

It is, therefore, a still further object of this invention to provide an improved catalyzer system for treating the exhaust gases without introducing large restrictions to exhaust gas flow.

It is yet a further object of this invention to provide an improved catalyzer system for an internal combustion engine wherein treatment of the exhaust gases is achieved without introducing substantial flow restrictions.

The problem of treating the exhaust gases in an outboard motor is particularly acute. One of the main reasons for this is due to the extremely compact nature of an outboard motor. In order to provide effective catalyzer treatment, it is normally the practice to use large catalyst beds and this is simply not practical with an outboard motor.

It is, therefore, a still further object of this invention to provide an effective catalyzer system for an outboard motor in which the exhaust gases can be effectively treated in a compact area.

SUMMARY OF THE INVENTION

One feature of this invention is adapted to be embodied in a marine propulsion system that comprises an internal combustion engine having an exhaust port for discharging exhaust gases from the engine. An exhaust system is incorporated for delivering the exhaust gases from the exhaust port to the atmosphere and this includes an underwater exhaust gas discharge for discharging exhaust gases at a point below the water level, an above the water exhaust gas discharge for discharging exhaust gases to the atmosphere above the water level and conduit means for delivering the exhaust gases from the exhaust port to the underwater exhaust gas discharge and the above the water exhaust gas discharge. In accordance with this feature of the invention, an exhaust gas catalyzer is disposed in the conduit means for contacting the exhaust gases passing through the exhaust port before entry to the atmosphere through either of the exhaust gas discharges.

Another feature of the invention is adapted to be embodied in an exhaust treatment system for an internal combustion engine that has an exhaust port for discharging exhaust gases and an exhaust system for delivering the exhaust gases from the exhaust port to the atmosphere through either of separate exhaust gas discharges. In accordance with this feature of the invention, an exhaust gas catalyzer is disposed in proximity to the exhaust port and upstream of each of the exhaust gas discharges for contact with the exhaust gases regardless of which exhaust gas discharge is utilized to discharge the exhaust gases to the atmosphere.

DETAILED DESCRIPTION OF THE PREFERRED EMBODIMENT

Figure 1:
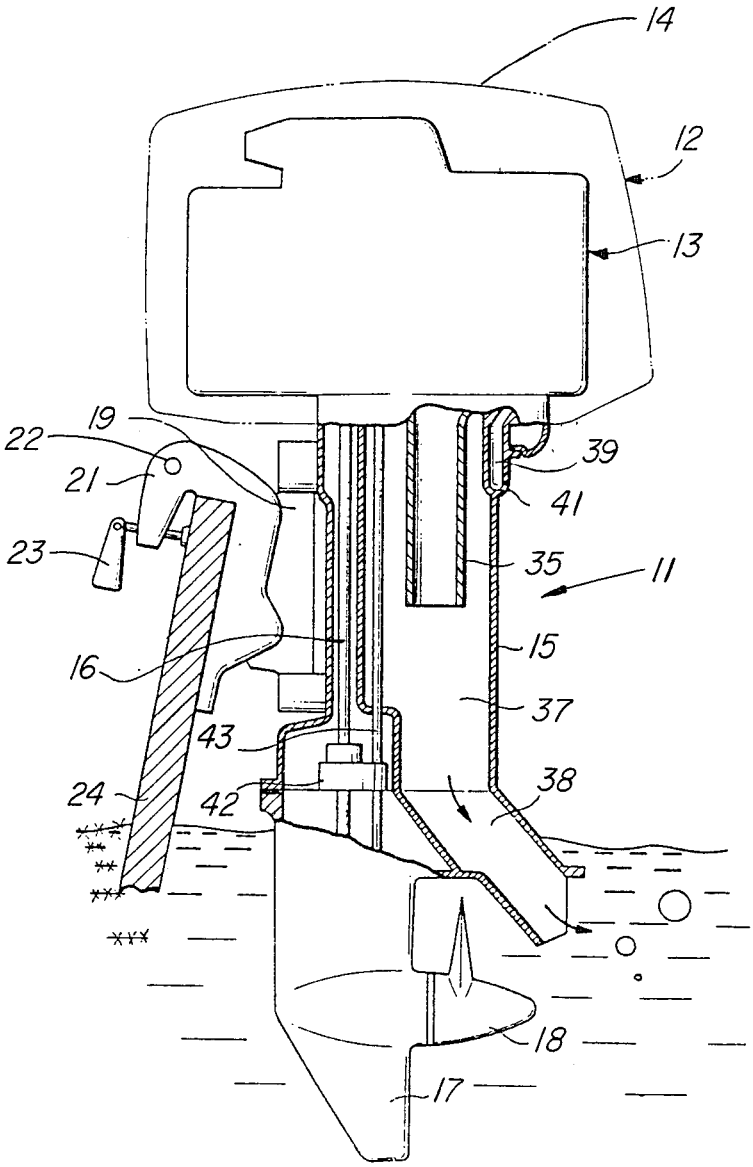
FIG. 1 is a side elevational view of an outboard motor constructed in accordance with an embodiment of the invention, with a portion broken away.

Referring first to FIG. 1, an outboard motor constructed in accordance with an embodiment of the invention is identified generally by the reference numeral 11. The outboard motor 11 is comprised of a power head, indicated generally by the reference numeral 12, which is comprised of an internal combustion engine 13 and a surrounding protective cowling, shown in phantom and indicated at 14. The engine 13 may be of any known type and, in the illustrated embodiment, is depicted as being of the two-cycle, two cylinder, inline type. The engine 13 is disposed so that its output shaft (not shown) rotates about a vertically extending axis.

A drive shaft housing 15 depends fromt he power head 12 and rotatably journals a drive shaft 16 that is rotatably coupled to the engine output shaft in a known manner. A lower unit 17 positioned beneath the drive shaft housing 15 rotatably journals a propeller 18 and its propeller shaft and drives the propeller 18 through a suitable forward, neutral, reverse transmission (not shown).

A steering shaft (not shown) is affixed to the drive shaft housing 15 and is rotatably journaled in a swivel bracket 19. This rotational movement accommodates steering of the outboard motor 11 about a vertically extending axis defined by the axis of rotation of the steering shaft within the swivel bracket 19.

The swivel bracket 19 is, in turn, pivotally connected to a clamping bracket 21 by means of a pivot pin 22. This pivotal connection permits tilting of the outboard motor 11 about the horizontally disposed axis defined by the pivot pin 22 for trim adjustment and so that the outboard motor 11 may be tilted up to an out of the water condition during trailering and when not in use. The clamping bracket 21 carries a clamping device 23 so as to permit attachment of the outboard motor 11 to a transom 24 of an associated watercraft. The general construction of the outboard motor 11 as thus far described may be considered to be conventional.

Figure 2:
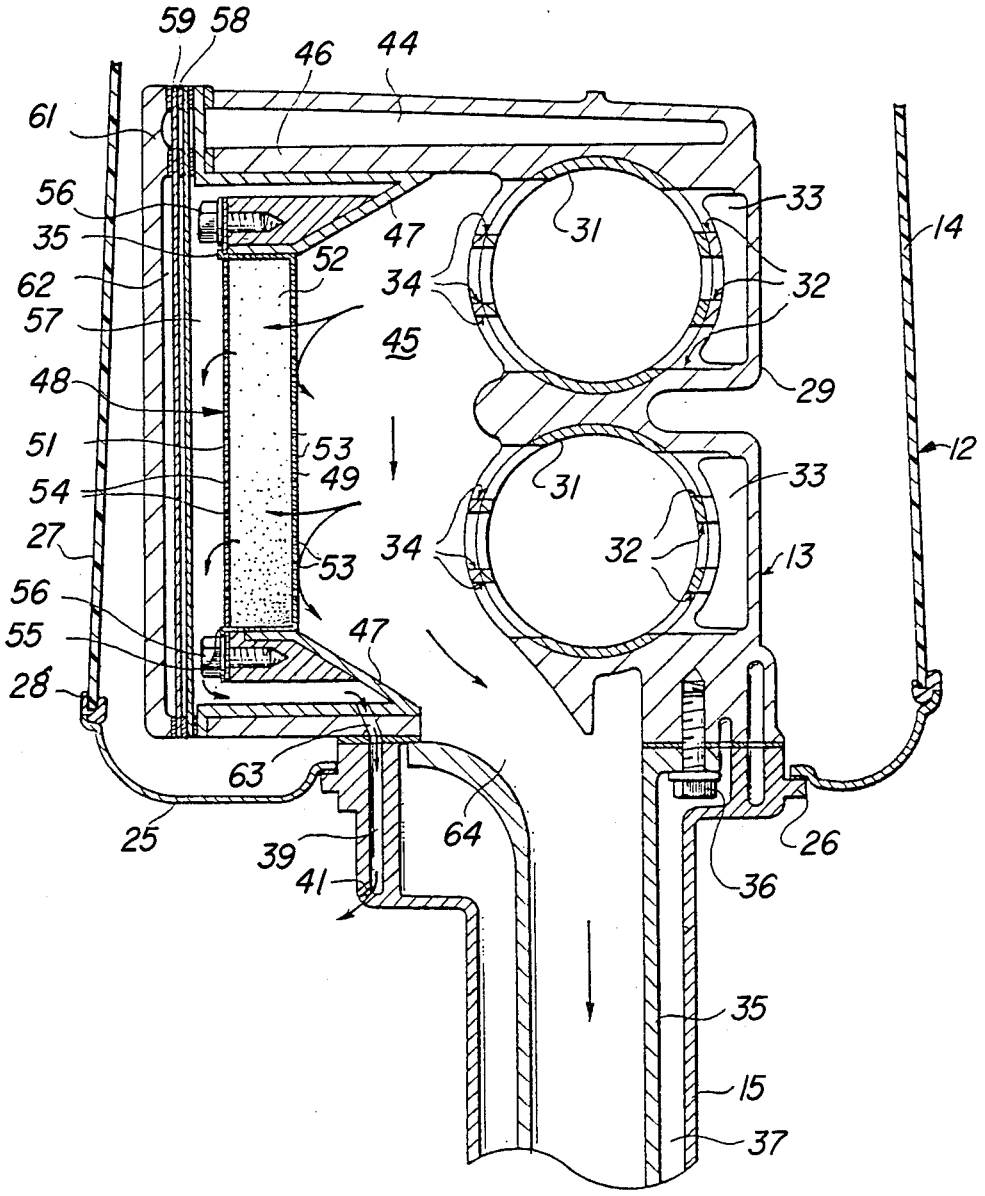
FIG. 2 is an enlarged cross-sectional view taken through the power head and upper portion of the drive shaft housing of the outboard motor as seen in FIG. 1.

Referring now primarily to FIG. 2, it will be seen that the protective cowling 14 includes a tray portion 25 that is supported on the upper end of the drive shaft housing 15 and specifically upon a flange 26 of the latter. The protective cowling 14 is completed by a main cowling portion 27 that carries a gasket 28 at its peripheral edge for sealing with the tray 22 so as to enclose the engine 13.

The engine 13 is only shown partially since the significant features of the invention deal with its exhaust system. Where not described, the components of the engine may be considered to be conventional. The engine 13 includes a cylinder block 29 in which cylinder liners 31 are fixed. The cylinder liners 31 support reciprocating pistons (not shown) that drive the engine output shaft through connecting rods in a well known manner. As has been previously noted, the engine is of the two-cycle type and operates on a crankcase compression principle. Therefore, a fuel/air mixture is delivered to the crankcase chambers of the engine and is transferred to the area above the pistons through scavenge ports 32 and scavenge passages 33 formed at one side of the cylinder block 29.

The exhaust gases from the individual combustion chambers are discharged through exhaust ports 34 into an exhaust system, to be described. The exhaust ports 34 are disposed diametrically opposite to the scavenge ports 32 so as to provide loop type scavenging for the engine.

The exhaust system for the engine 13 includes an exhaust pipe 35 that is affixed to the lower face of the cylinder block 29 by means of fasteners 36. The exhaust pipe 35 depends into an expansion chamber 37 (FIG. 1) formed within the drive shaft housing 15. The expansion chamber 37 serves to permit expansion and cooling of the exhaust gases before they are discharged through an underwater, high speed exhaust gas discharge 38 formed in the lower unit 17. Any form of underwater exhaust gas discharge of a known type may be employed for such discharge.

The exhaust system also includes a low speed, above the water exhaust gas discharge which includes an expansion chamber 39 that is formed in the upper portion of the drive shaft housing 15. Exhaust gases are discharged to the atmosphere under low speed running through an above the water exhaust gas discharge 41 which is formed in the drive shaft housing 15 and which directly communicates with the expansion chamber 39.

The engine 13 is also provided with a cooling system. In the illustrated embodiment, the engine 13 is water cooled and draws cooling water from the body of water in which the watercraft is operating. This is accomplished, in part, by means of a water pump 42 that is supported at the interface between the drive shaft housing 15 and the lower unit 17 and which is driven by the drive shaft 16 in a known manner. Water is drawn from the body in which the watercraft is operating through an appropriate inlet (not shown) and is pumped by the coolant pump 42 through a conduit 43 for delivery to the power head 12. This water is circulated in a suitable manner through a cooling jacket of the engine which includes a cylinder block cooling jacket 44 (FIG. 2). The coolant is then discharged back into the body of water in which the watercraft is operating in any suitable manner.

Referring now primarily to FIG. 2, an arrangement is provided for treating the exhaust gases before their discharge to the atmosphere either through the high speed underwater exhaust gas discharge 38 or through the low speed above the water exhaust gas discharge 41. This treatment system includes a collector section 45 that is formed in the cylinder block 29 in direct communication with the exhaust ports 34. The collector section 45 opens through one side 46 of the cylinder block 29. This opening is, however, closed by means including a supporting bracket 47 which, in turn, defines a generally open area that is closed by a perforate catalyzer bed 48.

The bed 48 is positioned in direct registry with the exhaust ports 34 and exhaust gases are channeled toward the catalyzer bed 48 by inclined surfaces of the supporting bracket 47. The catalyzer bed 48 includes an inner screen 49 and an outer screen 51 that defines an interior chamber in which a catalyzer material 52 of any desired type or a composite thereof is supported. The inner wall 48 is formed with perforate openings 53 while the outer wall 51 is formed with perforate openings 54. As a result of the perforate openings, exhaust gases can pass through the bed 48 in a manner to be described.

The inner wall 49 is formed with a flange 55 that is interlocked with the inner wall 51. The inner wall 51 has a peripheral flange that is clamped to the supporting bracket 47 by means of threaded fasteners 56.

A volume 57 is formed between the outer surface of the catalyzer bed 48 and a cover plate 58. The cover plate 58 overlies a flange of the bracket 47 and has affixed to it a further cover plate 59. The cover plates 58 and 59 are separated slightly from each other so as to define an insulating air gap. An outer cover plate 61 completes the assembly for closing the opening in the portion 46 of the cylinder block 29. A still further air gap 62 is provided between the outer cover plate 61 and the closure plate 59 for further heat insulation.

The bracket 47 and cylinder block 29 are provided with a low speed exhaust gas passage 63 that communicates the chamber 57 with the auxiliary expansion chamber 39 for delivering low speed exhaust gases to the low speed above the water exhaust gas discharge port 41.

The exhaust gases may also flow from the collector section 45 to the exhaust pipie 35 through a high speed exhaust gas passage 64.

The operation of the embodiment will now be described. When the outboard motor 11 is powering the associated watercraft at a high speed and the watercraft is, therefore, in a planing condition, there will be a fairly large exhaust gas pressure and the high speed exhaust gas discharge 38 will be relatively shallowly submerged. Under this condition, the exhaust gases will issue from the exhaust ports 34 at a high speed and impinge upon the catalyst bed 48. There will be sufficient contact under these conditions for the exhaust gases to become in contact with the catalyzer material 52 for their effective treatment. The exhaust gases are then redirected to the passage 64 and exhaust pipe 35 for discharge through the high speed underwater exhaust gas discharge 38.

Under the high speed exhaust gas condition, the flow resistance of the catalyzer bed 48 and the size of the passage 63 and above the water exhaust gas discharge 41, the latter of which are quite restricted, will prevent any significant discharge of exhaust gases to the atmosphere directly through the discharge 41. However, any gases that are discharged under this condition will have flown through the catalyzer bed 48 and have been effectively treated.

When the watercraft is operating at a slow speed, however, the high speed exhaust gas discharge 38 will be submerged sufficiently so as to preclude any exhaust gases from passing out of this discharge. Under this condition, the exhaust gases will flow through the catalyzer bed 48 before discharge through the passage 41. Hence, the exhaust gases are effectively treated by the catalyzer bed 48 regardless of whether they are discharged to the atmosphere through the high speed exhaust gas discharge 38 or the low speed exhaust gas discharge 41. Also, because of the location of the catalyzer bed 48 in confronting relationship with the exhaust ports 34, it will be unnecessary to place the catalyzer bed in a flow restricting position for high speed exhaust gas discharge where the exhaust gases must pass through it. Hence, there is effective treatment under all conditions with a relatively simple construction. It should also be noted from FIG. 2 that the catalyzer bed 48 may be conveniently replaced through removal of the upper main cowling portion 27 and the respective cover plates and threated fasteners 56.

It should be readily apparent from the foregoing description that a highly effective arrangement has been disclosed and which provides for exhaust gas treatment regardless of which exhaust gas discharge is employed for the transfer of the exhaust gases to the atmosphere. Although an embodiment of the invention has been illustrated and described, various changes and modifications may be made without departing from the spirit and scope of the invention, as defined by the appended claims.

I claim:

1. In a marine propulsion system comprising an internal combustion engine having an exhaust port for discharging exhaust gases, an exhaust system for delivering exhaust gases from said exhaust port to the atmosphere comprising an underwater exhaust gas discharge for discharging exhaust gases at a point below the water level, an above the water exhaust gas discharge for discharging exhaust gases to the atmosphere above the water level and conduit means for delivering exhaust gases from said exhaust port to said underwater exhaust gas discharge and to said above the water exhaust gas discharge, the improvement comprising an exhaust gas catalyzer bed disposed in said conduit means for contacting the exhaust gases passing from said exhaust port before entry to the atmosphere through either of said exhaust gas discharges, the exhaust gases passing through the bed before discharge to the atmosphere through one of the exhaust gas discharges and having only surface contact with the bed before discharge to the atmosphere through the other of the exhaust gas discharges.

2. In a marine propulsion system as set forth in claim 1 wherein the one exhaust gas discharge is the above the water exhaust gas discharge.

3. In a marine propulsion system as set forth in claim 1 wherein the catalyzer bed is disposed in facing relationship to the exhaust port for impingement of the exhaust gases thereupon.

4. In a marine propulsion system as set forth in claim 3 wherein the at least one exhaust gas discharge is the above the water exhaust gas discharge.

5. In a marine propulsion system as set forth in claim 1 wherein the exhaust gas catalyzer bed is disposed in a common portion of the conduit means.

6. In a marine propulsion system as set forth in claim 5 wherein the catalyzer bed is disposed in facing relationship to the exhaust port for impingement of the exhaust gases thereupon.

7. In a catalytic exhaust system for an internal combustion engine having an exhaust port for discharging exhaust gases, an exhaust system for delivering exhaust gases from said exhaust port to the atmosphere through either of a first exhaust gas discharge or a second exhaust gas discharge, said first exhaust gas discharge and said second exhaust gas discharge communicating with the atmosphere independently of each other, the improvement comprising an exhaust gas catalyzer disposed in said exhaust system for contacting the exhaust gases passing from said exhaust pipe to either of said exhaust gas discharges, said bed being in confronting relation to said exhaust prot for impingement of exhaust gases with the catalyst in said bed regardless of which exhaust gas discharges the exhaust gases flow to the atmosphere through.

8. In a catalytic exhaust system as set forth in claim 7 wherein the exhaust gas catalyzer comprises a catalyzer bed and the exhaust gases must flow through said bed before discharge to the atmosphere through at least one of the exhaust gas discharges.

9. In a catalytic exhaust system as set forth in claim 8 wherein the exhaust gases discharged through the other exhaust gas discharge contact the catalyzer bed only through surface contact therewith.

10. In a catalytic exhaust system as set forth in claim 7 wherein the exhaust gas catalyzer comprises a catalyzer bed disposed in a common portion of the conduit means.

* * * * *